US010948252B1

(12) United States Patent
Bender

(10) Patent No.: US 10,948,252 B1
(45) Date of Patent: Mar. 16, 2021

(54) TRIGGER WITH DISCONNECTOR TRAVEL STOP

(71) Applicant: In Ovation LLC, Vadnais Heights, MN (US)

(72) Inventor: Terrence Dwight Bender, Minneapolis, MN (US)

(73) Assignee: In Ovation LLC, Vadnais Heights, MN (US)

( * ) Notice: Subject to any disclaimer, the term of this patent is extended or adjusted under 35 U.S.C. 154(b) by 0 days.

(21) Appl. No.: 16/591,536

(22) Filed: Oct. 2, 2019

(51) Int. Cl.
*F41A 19/16* (2006.01)
*F41A 19/10* (2006.01)

(52) U.S. Cl.
CPC ..... *F41A 19/16* (2013.01); *F41A 19/10* (2013.01)

(58) Field of Classification Search
CPC ..... F41A 19/16; F41A 19/33; F41A 19/44; F41A 19/45; F41A 19/46; F41A 19/47; F41A 19/12; F41A 19/10
See application file for complete search history.

(56) References Cited

U.S. PATENT DOCUMENTS 5,623,114 A * 4/1997 Soper ..... F41A 19/46 89/141
8,985,006 B1 * 3/2015 Christensen ..... F41A 17/82 89/142
10,006,733 B2 * 6/2018 Bender ..... F41A 19/10

FOREIGN PATENT DOCUMENTS

DE 102006048436 A1 * 2/2008 ..... F41A 17/46

* cited by examiner

*Primary Examiner* — Stephen Johnson
(74) *Attorney, Agent, or Firm* — Laabs Intellectual Property

(57) ABSTRACT

In some embodiments, a fire control mechanism comprises a trigger arranged to pivot about an axis and a disconnector arranged to pivot about the axis with respect to the trigger. The disconnector comprises a first stop and a second stop. A distance between the axis and the second stop is greater than a distance between the axis and the first stop. The disconnector comprises a first orientation and a second orientation, and a disconnector spring is arranged to bias the disconnector to the first orientation. The first stop contacts a first interfering surface in the first orientation and the second stop contacts a second interfering surface in the second orientation.

16 Claims, 5 Drawing Sheets

TRIGGER WITH DISCONNECTOR TRAVEL STOP

BACKGROUND OF THE INVENTION

This invention relates to firearm control systems and triggers. Firearms are generally known in the art. The AR platform is known in the art and includes many variations. The AR lower receiver has certain standardized dimensions and can be used with a variety of different gun parts to make a wide range of firearms. Rifles, pistols and pistol caliber carbines (PCCs) can all use an AR lower receiver.

The AR lower receiver is arranged to carry a fire control mechanism that uses standardized dimensions, and many different drop-in trigger systems exist.

Pistol caliber carbines are known to be hard on triggers. When a round is fired, high energy blowback rotates the hammer, disconnector and trigger components and causes the components to contact one another. A common trigger failure is the disconnector spring, which can bottom out and fail due to over compression, especially under high firing rates.

There remains a need for novel trigger designs that are useable in a variety of firearm platforms and are capable of an extended service life. There remains a need for light-weight firearm triggers that do not fail under the operating conditions experienced in an AR pistol caliber carbine firearm.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a fire control mechanism comprises a trigger arranged to pivot about an axis and a disconnector arranged to pivot about the axis with respect to the trigger. The disconnector comprises a first stop and a second stop. A distance between the axis and the second stop is greater than a distance between the axis and the first stop. The disconnector comprises a first orientation and a second orientation, and a disconnector spring is arranged to bias the disconnector to the first orientation. The first stop contacts a first interfering surface in the first orientation and the second stop contacts a second interfering surface in the second orientation.

In some embodiments, the trigger comprises the second interfering surface.

In some embodiments, the trigger comprises a first sidewall, a second sidewall and a connecting member extending between the first sidewall and the second sidewall, wherein the connecting member comprises the second interfering surface.

In some embodiments, the trigger comprises a first spring seat and the disconnector comprises a second spring seat. The disconnector spring is positioned between the first spring seat and the second spring seat.

In some embodiments, a distance between the first spring seat and the second spring seat in the second orientation is greater than a minimum operating size of the disconnector spring.

In some embodiments, the distance between the axis and the second stop is greater than a distance between the axis and the disconnector spring.

In some embodiments, the first stop and the second stop are located at opposite ends of the disconnector.

In some embodiments, a fire control mechanism comprises a trigger arranged to pivot about an axis. The trigger comprises a first seat. A disconnector is arranged to pivot about the axis with respect to the trigger. The disconnector comprises a second seat. A disconnector spring extends between the first seat and the second seat. The disconnector spring biases the disconnector in a first rotational direction about the axis. The disconnector comprises a rotation stop arranged to limit rotation of the disconnector in a second rotational direction about the axis. A distance from the axis to the rotation stop is greater than a distance from the axis to the disconnector spring.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
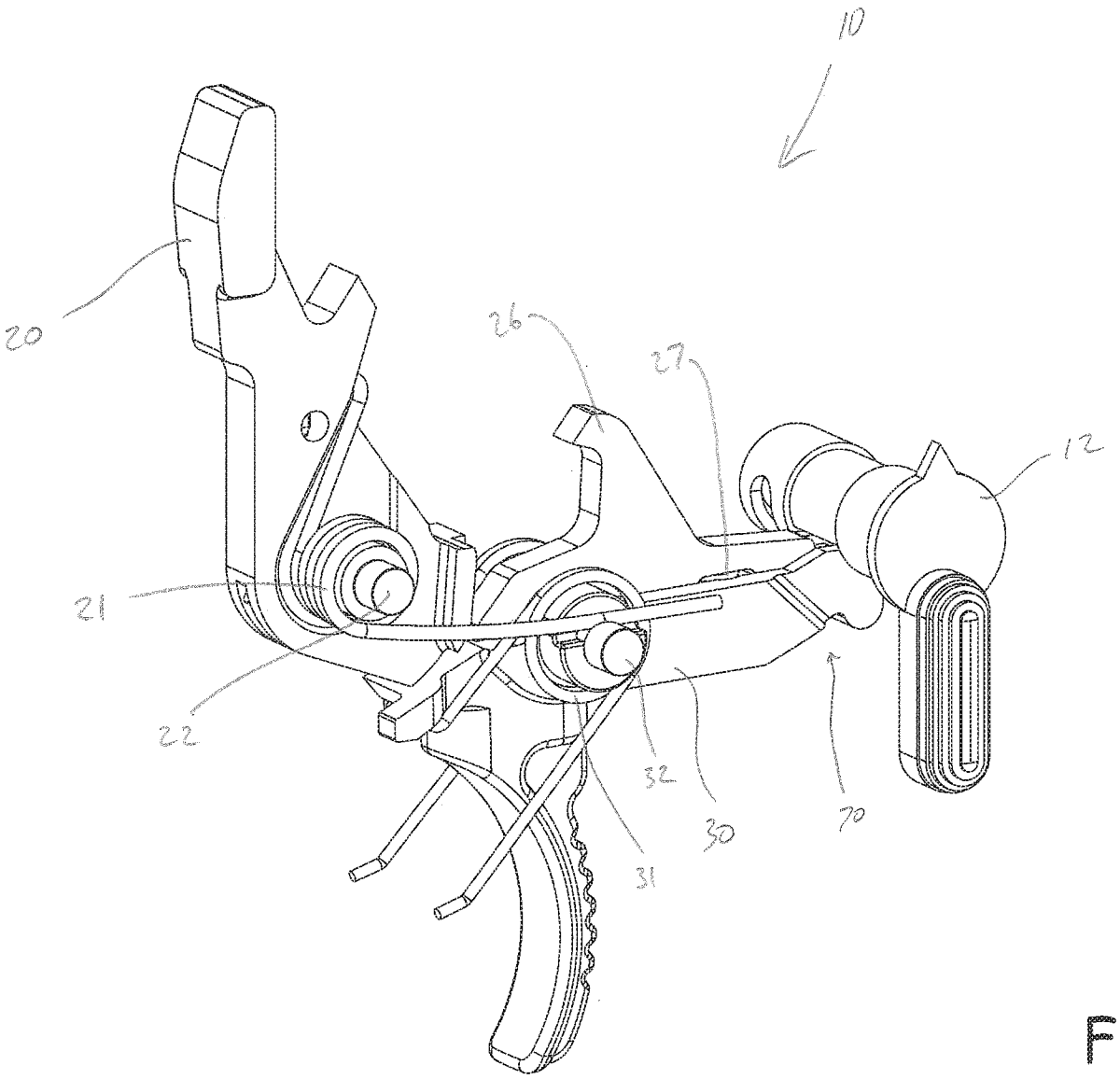
FIG. 1 shows an embodiment of a fire control mechanism.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

Figure 2:
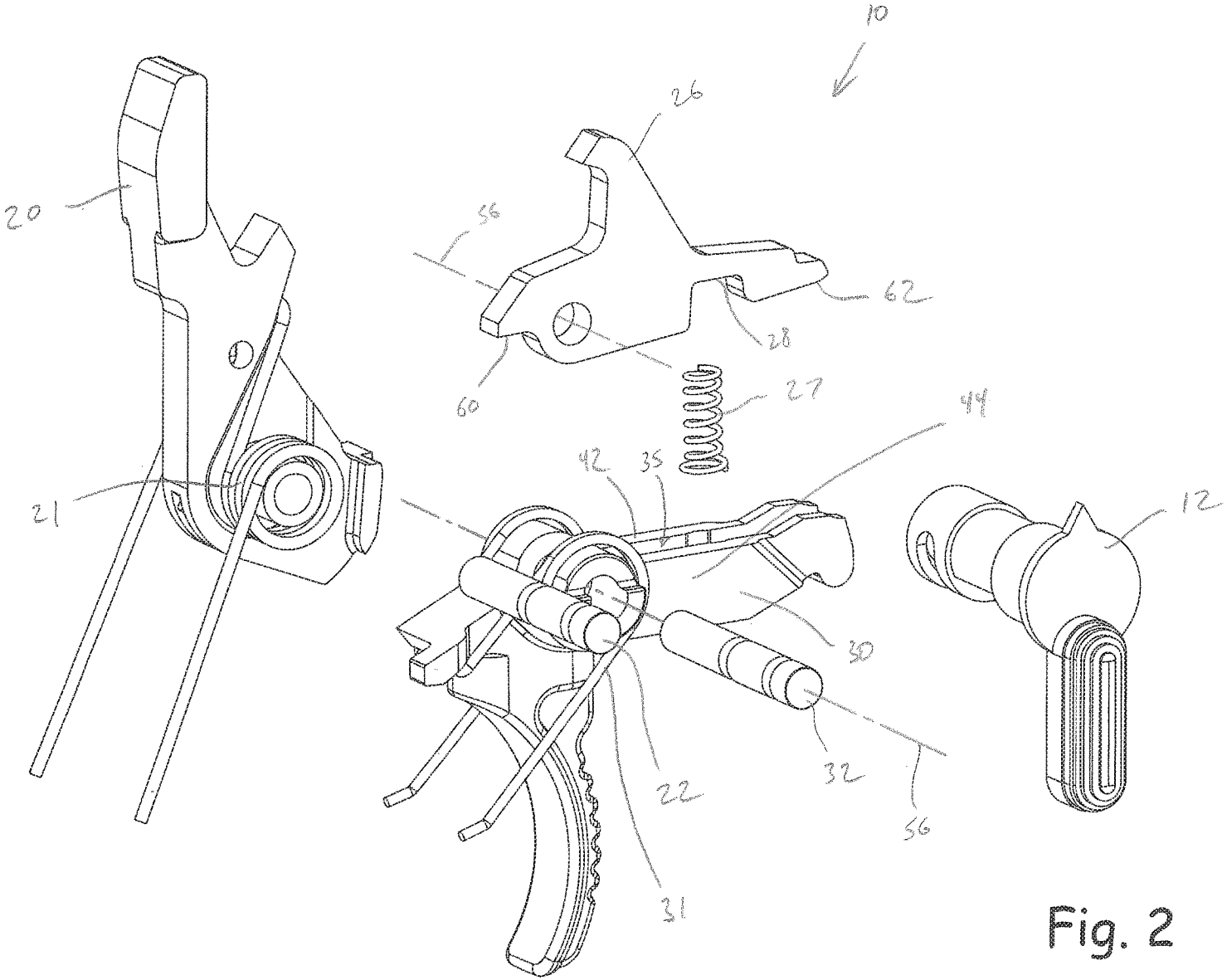
FIG. 2 shows an exploded view of the fire control mechanism shown in FIG. 1.
Figure 3:
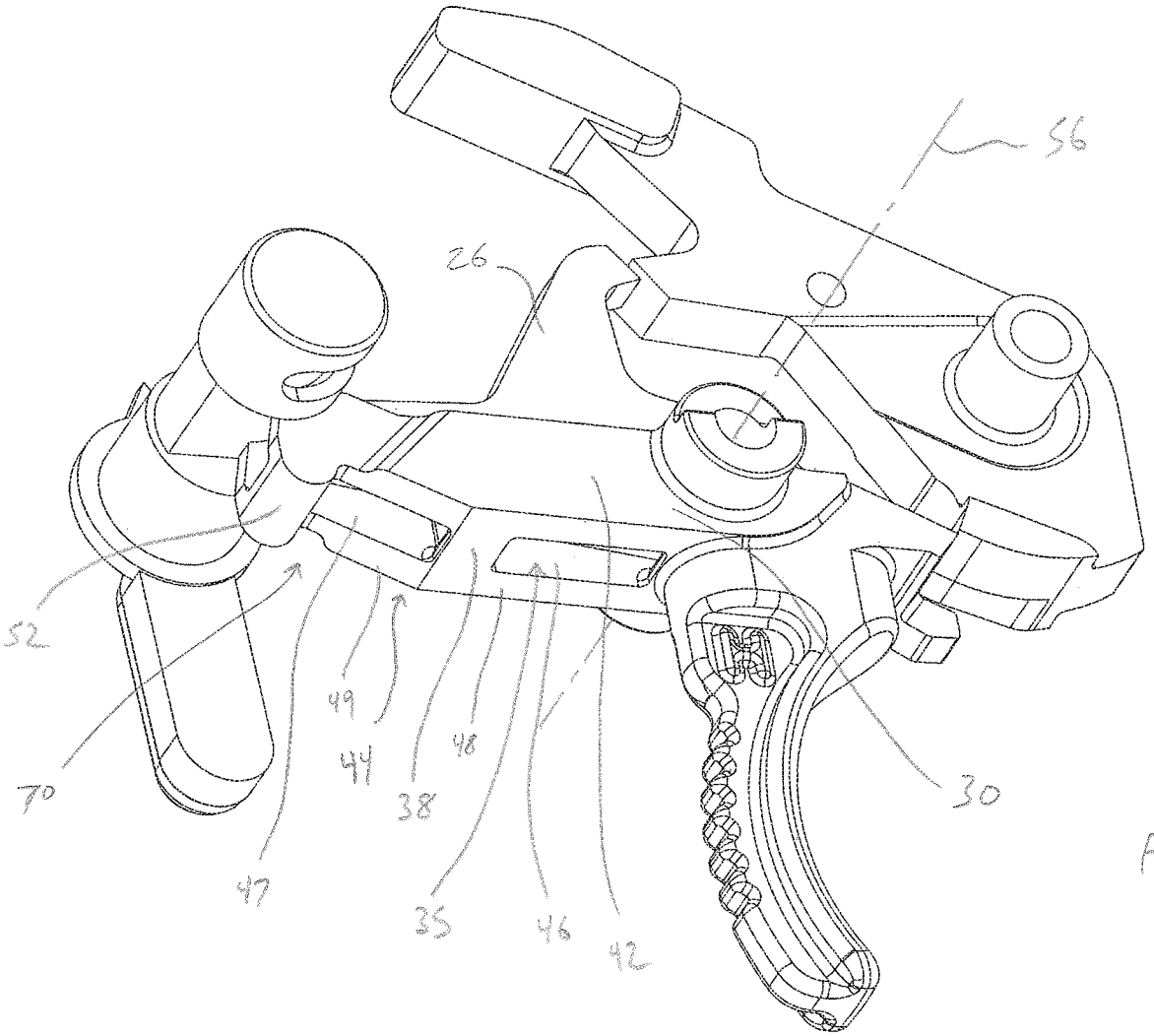
FIG. 3 shows another view of the fire control mechanism shown in FIG. 1.

FIGS. 1-3 show an embodiment of a fire control mechanism 10. In some embodiments, a fire control mechanism 10 comprises a hammer 20, a trigger 30, a disconnector 26 and a safety mechanism 12. In some embodiments, the hammer 20 is arranged to rotate on a hammer pin 22 and biased by a hammer spring 21. In some embodiments, the trigger 30 is arranged to rotate on a trigger pin 32 and biased by a trigger spring 31. In some embodiments, the disconnector 26 is arranged to rotate on the trigger pin 32. In some embodiments, the trigger 30 and disconnector 26 are arranged to rotate about an axis 56. In some embodiments, the axis 56 is collinear with a central axis of the trigger pin 32. In some embodiments, a disconnector spring 27 is arranged to provide opposing rotational forces on the trigger 30 and disconnector 26.

In some embodiments, the trigger 30 comprises a cavity 35 and a portion of the disconnector 26 is oriented within the cavity 35. In some embodiments, the trigger 30 comprises a first sidewall 42 and a second sidewall 44, and the sidewalls 42, 44 at least partially define the cavity 35.

In some embodiments, the trigger 30 comprises features as taught in U.S. Pat. No. 10,006,733, the entire content of which is hereby incorporated herein by reference.

In some embodiments, the trigger 30 comprises an aperture 46 extending through a floor portion of cavity 35. The aperture 46 allows material such as carbon fouling to exit the cavity 35.

In some embodiments, the trigger 30 comprises a first portion 48 and a second portion 49, wherein the first portion 48 is oriented at an angle to the second portion 49. In some embodiments, each portion 48, 49 is straight. In some embodiments, the first portion 48 extends rearward from the axis 56 of the trigger 30. In some embodiments, the second portion 49 defines a clearance area 70 located under the trigger 30 structure, which can store accumulated fouling material without impacting the operation of the fire control mechanism 10. In some embodiments, the trigger 30 comprises a second aperture 47 into the cavity 35. In some embodiments, the second aperture 47 is located in the second portion 49 adjacent to the clearance area 70.

In some embodiments, the trigger 30 comprises a bridge 38 extending between the first sidewall 42 and the second sidewall 44. In some embodiments, the bridge 38 comprises a floor of the cavity 35. In some embodiments, the bridge 38 is located between the first aperture 46 and the second aperture 47.

In some embodiments, the trigger 30 comprises a connecting member 52 extending between the first sidewall 42 and the second sidewall 44. In some embodiments, the connecting member 52 is located farther away from the axis 56 than the bridge 38. In some embodiments, the connecting member 52 comprises a curved lower surface.

Figure 4:
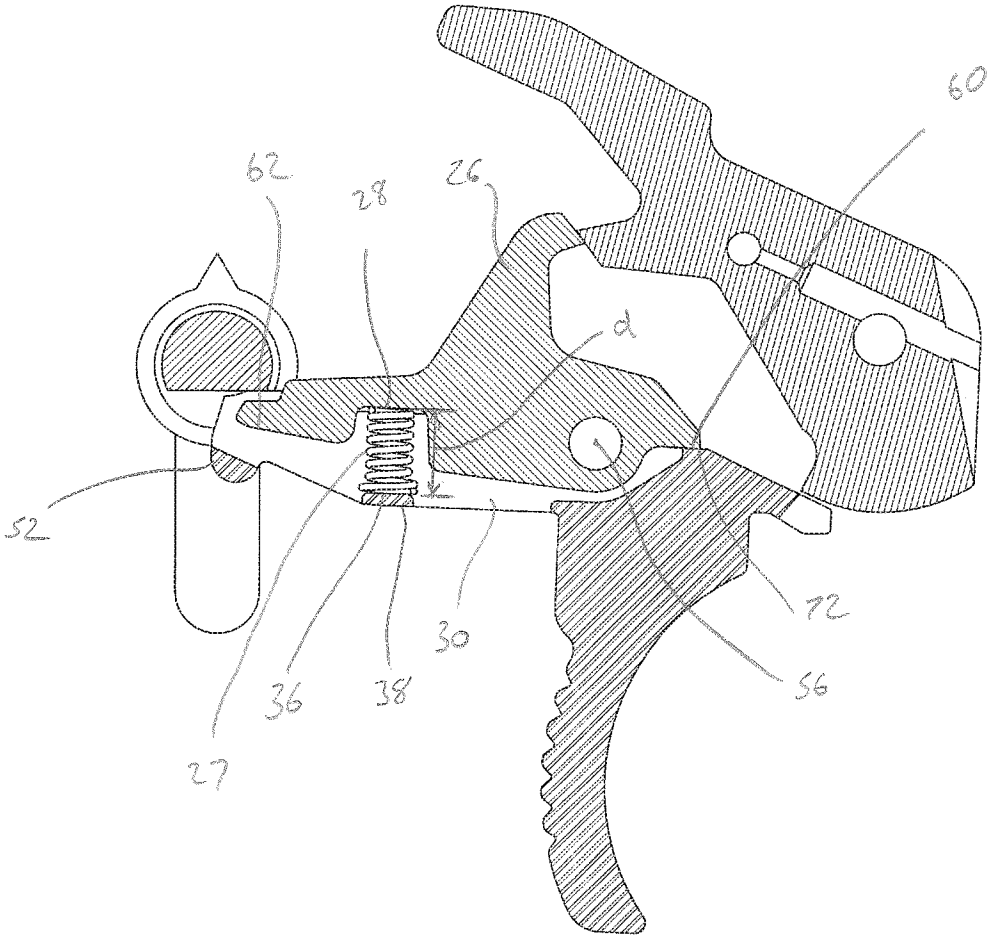
FIG. 4 shows a cross-sectional view of an embodiment of a fire control mechanism in a first orientation.
Figure 5:
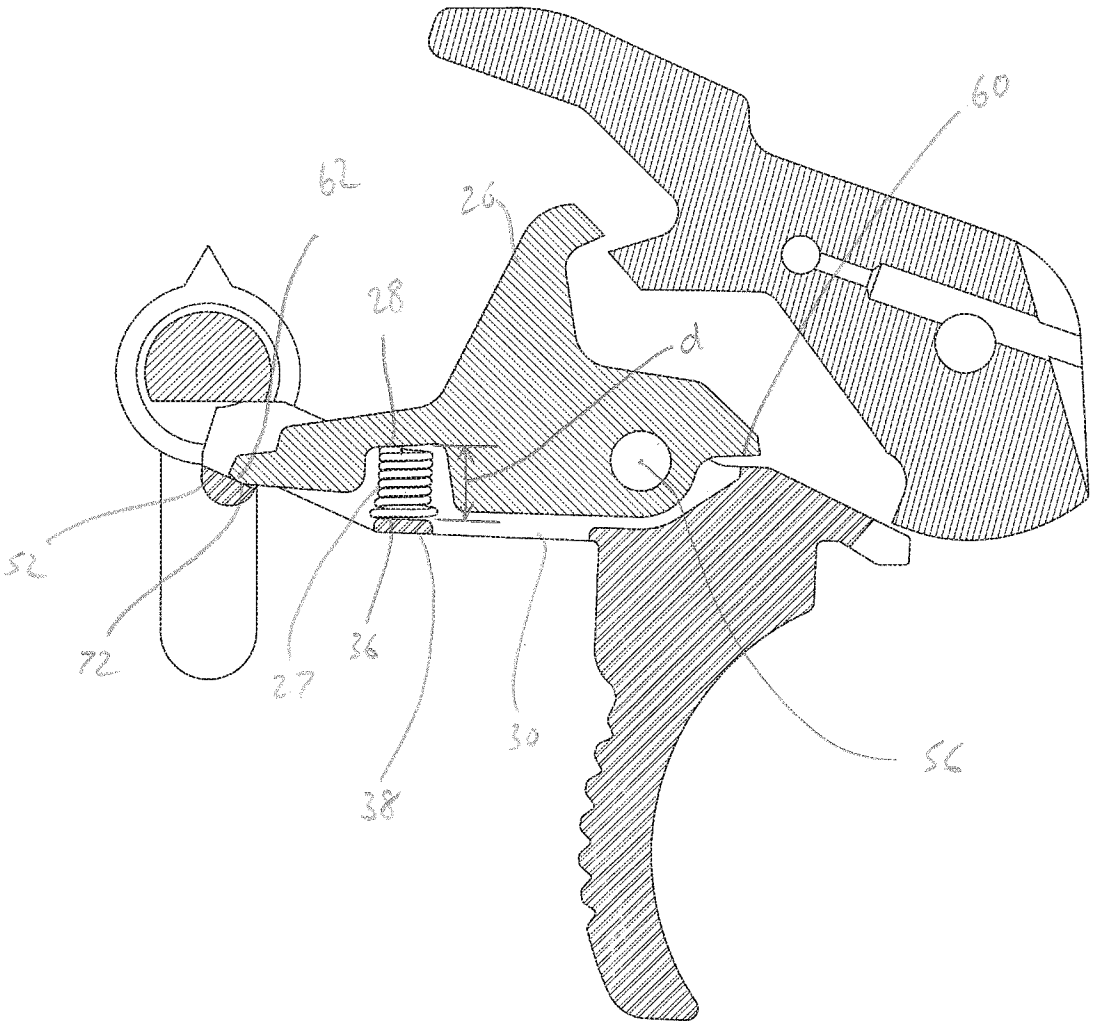
FIG. 5 shows a cross-sectional view of an embodiment of a fire control mechanism in a second orientation.

FIGS. 4 and 5 show cross-sectional views of an embodiment of a fire control mechanism 10. Desirably, at least some components of the fire control mechanism 10 are moveable between a first orientation and a second orientation. In some embodiments, the fire control mechanism 10 will temporarily assume each of the first and second orientations during a firing cycle. In some embodiments, the disconnector 26 moves with respect to the trigger 30 as the fire control mechanism 10 transitions from the first orientation to the second orientation. FIG. 4 shows an embodiment of a first orientation and FIG. 5 shows an embodiment of a second orientation of the disconnector 26 with respect to the trigger 30.

In some embodiments, the trigger 30 comprises a first spring seat 36. In some embodiments, the disconnector 26 comprises a second spring seat 28. In some embodiments, the disconnector spring 27 is installed between the trigger 30 and the disconnector 26. In some embodiments, a first portion of the disconnector spring 27 contacts the first spring seat 36. In some embodiments, a second portion of the disconnector spring 27 contacts the second spring seat 28. A spring seat can comprise any suitable structure arranged to contact and/or contain the spring 27. In some embodiments, a spring seat comprises a contacting surface arranged to place the spring 27 in compression. In some embodiments, a spring seat comprises a laterally reinforcing surface arranged to prevent lateral movement of the spring 27, for example comprising a cavity sidewall or a post.

In some embodiments, the trigger 30 and disconnector 26 are arranged to rotate about the axis 56. In some embodiments, the disconnector 26 is rotatable with respect to the trigger 30 about the axis 56 between a first stop position and a second stop position. In some embodiments, the disconnector 26 comprises the first stop position when the fire control mechanism 10 is in the first orientation, for example as shown in FIG. 4. In some embodiments, the disconnector 26 comprises the second stop position when the fire control mechanism 10 is in the second orientation, for example as shown in FIG. 5.

In some embodiments, the disconnector 26 comprises a first rotation stop 60 and a second rotation stop 62. In some embodiments, the first rotation stop 60 is arranged to limit rotation of the disconnector 26 in a first direction about the axis 56. In some embodiments, the first rotation stop 60 is arranged to contact the trigger 30. As shown in FIG. 4, the first rotation stop 60 is arranged to limit rotation of the disconnector 26 in a clockwise direction.

In some embodiments, a distance d between the first spring seat 36 and the second spring seat 28 changes as the disconnector 26 moves with respect to the trigger 30. In some embodiments, when the first rotation stop 60 operates, for example by abutting an interfering surface 72, a distance between the first spring seat 36 and the second spring seat 28 is at a maximum.

In some embodiments, the second rotation stop 62 is arranged to limit rotation of the disconnector 26 in a second direction about the axis 56. In some embodiments, the second rotation stop 62 is arranged to contact the trigger 30. As shown in FIG. 5, the second rotation stop 62 is arranged to limit rotation of the disconnector 26 in a counter-clockwise direction. In some embodiments, the second rotation stop 62 contacts the connecting member 52 of the trigger 30.

In some embodiments, when the second rotation stop 62 operates, for example by abutting an interfering surface 72, a distance between the first spring seat 36 and the second spring seat 28 is at a minimum.

In some embodiments, the second rotation stop 62 is arranged to protect the disconnector spring 27. In some embodiments, the disconnector spring 27 comprises a minimum operating size, for example when under load. In some embodiments, the disconnector spring 27 comprises a coiled spring. In some embodiments, the disconnector spring 27 comprises a free length when not under load and a loaded height when under a compressive load. In some embodiments, the minimum operating size comprises a minimum loaded height for the disconnector spring 27. In some embodiments, adjacent coil turns of the disconnector spring 27 are in contact at the minimum operating size, and further compression will result in damage to the disconnector spring 27.

In some embodiments, the distance d between the first spring seat 36 and the second spring seat 28 is always greater than the minimum operating size of the disconnector spring 27 throughout the range of motion of the fire control mechanism 10. In some embodiments, the distance d between the first spring seat 36 and the second spring seat 28 is equal to or greater than the minimum operating size of the disconnector spring 27 when the fire control mechanism 10 is in the second orientation. In some embodiments, the distance d between the first spring seat 36 and the second spring seat 28 is equal to or greater than the minimum operating size of the disconnector spring 27 when the second rotation stop 62 operates to limit rotation of the disconnector 26.

In some embodiments, the first rotation stop 60 and the second rotation stop 62 are located at opposite ends of the disconnector 26. In some embodiments, the axis 56 is located between the first rotation stop 60 and the second rotation stop 62. In some embodiments, the disconnector spring 27 is located between the first rotation stop 60 and the second rotation stop 62. In some embodiments, the disconnector spring 27 is located between the axis 56 and the second rotation stop 62.

In some embodiments, a distance between the axis 56 and the first rotation stop 60 is less than a distance between the axis 56 and the second rotation stop 62.

In some embodiments, a distance between the axis 56 and the second rotation stop 62 is greater than a distance between the axis 56 and the spring distance between the axis and the second stop being greater than a distance between the axis and the disconnector spring 27. This configuration provides a moment arm distance to the second rotation stop 62 that exceeds a moment arm distance to the disconnector spring 27. In some embodiments, the second rotation stop 62 is located at an end of the disconnector 26. In some embodiments, this configuration will maximize the moment arm distance for the second rotation stop 62. Increasing the moment arm distance for the second rotation stop 62 will reduce the amount of force carried by the disconnector 26 when the second rotation stop 62 causes a counteracting torque.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A fire control mechanism comprising:

a trigger arranged to pivot about an axis, the trigger comprising a first sidewall and a second sidewall defining a cavity, a connecting member extending between the first sidewall and the second sidewall, a lower surface of the trigger comprising an aperture into the cavity, the aperture adjacent to the connecting member;

a disconnector arranged to pivot about the axis with respect to the trigger, the disconnector comprising a first stop and a second stop, a distance between the axis and the second stop being greater than a distance between the axis and the first stop, the disconnector comprising a first orientation and a second orientation; and a disconnector spring arranged to bias the disconnector to the first orientation;

wherein the first stop contacts a first interfering surface in the first orientation and the second stop contacts the connecting member in the second orientation.

2. The fire control mechanism of claim 1, the connecting member comprising a first portion and a second portion, the first portion contacting the disconnector, the second portion comprising curvature.

3. The fire control mechanism of claim 2, the first portion and the second portion facing opposite directions.

4. The fire control mechanism of claim 1, the trigger comprising a first spring seat, the disconnector comprising a second spring seat, the disconnector spring positioned between the first spring seat and the second spring seat.

5. The fire control mechanism of claim 4, wherein a distance between the first spring seat and the second spring seat in the second orientation is greater than a minimum operating size of the disconnector spring.

6. The fire control mechanism of claim 1, wherein the distance between the axis and the second stop is greater than a distance between the axis and the disconnector spring.

7. The fire control mechanism of claim 1, wherein the first stop and the second stop are located at opposite ends of the disconnector.

8. The fire control mechanism of claim 1, wherein a portion of the disconnector is oriented in the aperture in the second orientation.

9. A fire control mechanism comprising:

a trigger arranged to pivot about an axis, the trigger comprising a first sidewall and a second sidewall defining a cavity, a connecting member extending between the first sidewall and the second sidewall, a lower surface of the trigger comprising an aperture into the cavity, the aperture adjacent to the connecting member, the trigger comprising a first seat;

a disconnector arranged to pivot about the axis with respect to the trigger, the disconnector comprising a second seat;

a disconnector spring extending between the first seat and the second seat, the disconnector spring biasing the disconnector in a first rotational direction about the axis;

wherein the disconnector comprises a rotation stop arranged to limit rotation of the disconnector in a second rotational direction about the axis, the rotation stop arranged to contact the connecting member, a distance from the axis to the rotation stop being greater than a distance from the axis to the disconnector spring.

10. The fire control mechanism of claim 9, the connecting member comprising a first portion and a second portion, the first portion contacting the rotation stop, the second portion comprising curvature.

11. The fire control mechanism of claim 10, the first portion and the second portion facing opposite directions.

12. The fire control mechanism of claim 9, wherein a distance between the first spring seat and the second spring seat is greater than a minimum operating size of the disconnector spring when the rotation stop operates to limit rotation of the disconnector.

13. The fire control mechanism of claim 9, wherein the rotation stop comprises a second rotation stop, the disconnector further comprising a first rotation stop arranged to limit rotation of the disconnector about the axis in the first rotational direction, wherein the axis is located between the first rotation stop and the second rotation stop.

14. The fire control mechanism of claim 13, a distance between the axis and the second rotation stop being greater than a distance between the axis and the first rotation stop.

15. The fire control mechanism of claim 13, wherein the first rotation stop and the second rotation stop are located at opposite ends of the disconnector.

16. The fire control mechanism of claim 9, wherein a portion of the disconnector is arranged to occupy a portion of the aperture.

* * * * *